US007103942B2

(12) United States Patent
Youngberg

(10) Patent No.: US 7,103,942 B2
(45) Date of Patent: Sep. 12, 2006

(54) BUCKLE FOR STRAPPING USED IN A WATER HEATER SECURITY SYSTEM

(75) Inventor: Eric Ezra Youngberg, Yorba Linda, CA (US)

(73) Assignee: Little Firefighter Corporation, Santa Ana, CA (US)

( * ) Notice: Subject to any disclaimer, the term of this patent is extended or adjusted under 35 U.S.C. 154(b) by 0 days.

(21) Appl. No.: 10/728,709

(22) Filed: Dec. 5, 2003

(65) Prior Publication Data

US 2005/0121568 A1 Jun. 9, 2005

(51) Int. Cl.
*A44B 11/10* (2006.01)

(52) U.S. Cl. ..... 24/171; 24/68 CD; 24/196; 248/313; 248/500

(58) Field of Classification Search ..... 248/599, 248/505, 499, 351, 357, 218.4, 219.3, 316; 24/19, 68 R, 69 ST, 68 A, 68 BT, 68 E, 307, 24/163 R, 171, 182, 194, 197, 196, 265 R, 24/265 BC See application file for complete search history.

(56) References Cited

U.S. PATENT DOCUMENTS

| | | | | | |
|---|---|---|---|---|---|
| 510,358 | A | | 12/1893 | Mullane | |
| 550,112 | A | * | 11/1895 | Schneider | 24/171 |
| 1,490,596 | A | | 4/1924 | Dalton | |
| 2,542,044 | A | * | 2/1951 | Miller et al. | 24/196 |
| 2,754,560 | A | * | 7/1956 | Warner et al. | 24/196 |
| 2,919,481 | A | * | 1/1960 | Finken et al. | 24/196 |
| 3,162,916 | A | | 12/1964 | McHugh | |
| 3,390,436 | A | * | 7/1968 | Prete, Jr. | 24/196 |
| 3,805,988 | A | * | 4/1974 | Walker et al. | 220/23.89 |
| 3,894,707 | A | * | 7/1975 | Heard | 248/230.9 |
| 3,967,347 | A | * | 7/1976 | Bickis, Sr. | 24/200 |
| 4,131,976 | A | | 1/1979 | Bengtsson | |
| 4,136,422 | A | * | 1/1979 | Ivanov et al. | 24/170 |
| 5,190,260 | A | * | 3/1993 | Daubenspeck | 248/313 |
| 5,487,518 | A | * | 1/1996 | McCraney et al. | 248/225.11 |
| 5,871,183 | A | * | 2/1999 | Milluzzi | 248/96 |
| 5,983,573 | A | * | 11/1999 | MacKarvich | 52/23 |
| 6,138,864 | A | * | 10/2000 | Enochs | 220/845 |
| 6,202,977 | B1 | * | 3/2001 | Chapman | 248/505 |
| 6,254,052 | B1 | * | 7/2001 | Hubbard et al. | 248/313 |
| 6,340,143 | B1 | | 1/2002 | McCraney | |
| 6,665,913 | B1 | * | 12/2003 | Kosh et al. | 24/193 |
| 2003/0066939 | A1 | | 4/2003 | Foreman | |

FOREIGN PATENT DOCUMENTS

| | | |
|---|---|---|
| AT | 153991 | 1/1938 |
| CH | 678260 A5 | 8/1991 |

* cited by examiner

*Primary Examiner*—Anita M. King
(74) *Attorney, Agent, or Firm*—Myers Dawes Andras & Sherman LLP; Vic Y. Lin

(57) ABSTRACT

A water heater security system includes a woven, flexible strap disposed around a water heater to maintain the water heater in a fixed relationship with an adjacent wall. The system includes a pair of wall brackets and may include a buckle assembly. The strap may be formed with two or four ends at least one of which is adjustably attachable to one of the wall brackets or buckle. The buckle can be stamped from metal and bent back on itself to form a slide channel with two sidebars and a crossbar. A slide is disposed within the channel. Side flanges can be formed on the buckle portions or the slide.

5 Claims, 6 Drawing Sheets

FIG. 12
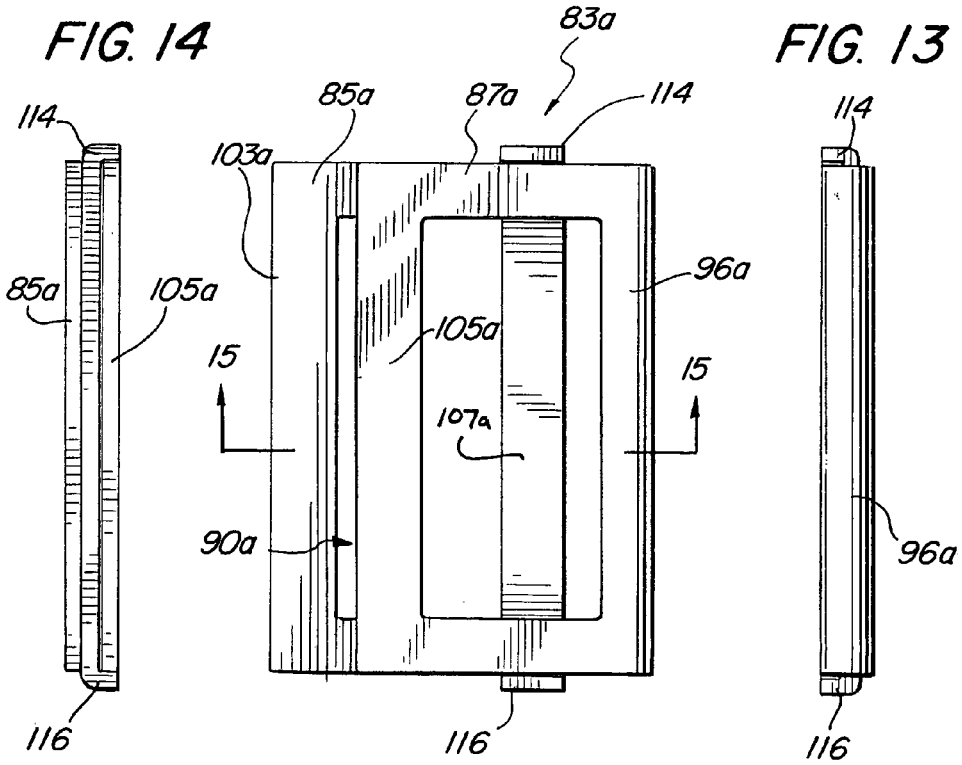
FIG. 14
FIG. 13
FIG. 15
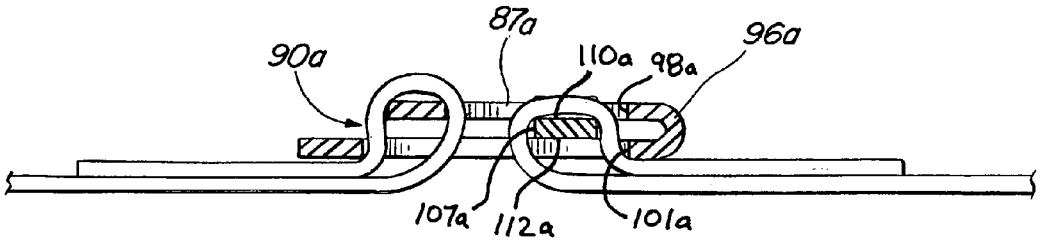

BUCKLE FOR STRAPPING USED IN A WATER HEATER SECURITY SYSTEM

BACKGROUND OF THE INVENTION

1. Field of the Invention

This invention relates generally to water heater security systems and more specifically to systems including straps for maintaining the water heater in a fixed relationship with an adjacent wall.

2. Discussion of Related Art

Water heaters are commonly used to provide water at an elevated temperature such as 140° F. This hot water is then distributed throughout a facility for use in various processes such as cooking and cleaning. These facilities may be commercial buildings, but even more commonly will be residential buildings.

From a safety standpoint, the high temperature of water does not present a problem as long as it remains in the water heater. However, if the water heater is upset, for example by an earthquake, the large volume of water and the high temperature of the water can result in considerable destruction to the facility and a safety risk to any people in the vicinity. Broken gas lines and water lines often accompany such a catastrophe. Accordingly, it has been desirable to provide water heaters with strap systems that can hold the water heater in a fixed relationship with an adjacent wall. These strap systems have commonly included wall brackets and metal straps providing sufficient strength to support the weight of a fully loaded water heater.

In order to maintain the cost of these strap systems as minimal as possible, the metal straps have not been highly machined. As a result the metal straps have retained very sharp edges that are particularly detrimental to installers. The metal straps have been fairly rigid, making them even more difficult to install. Wherever the straps have been punched cut bent back on themselves, for example at the wall brackets, points of weakness have been created substantially degrading the integrity of the strap system.

SUMMARY OF THE INVENTION

In accordance with the present invention, a water heater security system is provided with flexible straps typically woven from nylon or a polyester material to accommodate tensile stresses approaching those of the metal straps. Of course the woven straps do not have sharp edges and are not rigid, so they are easily and safely adapted for installation. Special wall brackets can be provided to attach the ends of the strap to the adjacent wall.

The wall brackets can be formed to receive a strap in a permanently fixed relationship or an adjustably fixed relationship. In other embodiments, free ends of two straps can be engaged by a buckle between the two wall brackets.

The buckle may include first portions that are bent back on second portions of the buckle to form a slide channel therebetween. A slide movable within the channel is engagable by one of the strap ends in a variably fixed relationship to provide a snug fit of the strap around the water heater. Side flanges can be provided either on the slide or on the second portions of the buckle to maintain the slide within the channel.

These and other features and advantages of the invention will become more apparent with a description of preferred embodiments and reference to the associated drawings.

DESCRIPTION OF THE DRAWINGS

FIG. 12 is a top plan view of a further embodiment of the buckle of the present invention;

FIG. 13 is a right side elevation view of the buckle of FIG. 12;

FIG. 14 is a left side elevation view of the buckle of FIG. 12;

FIG. 15 is a cross section view taken along lines 15—15 of FIG. 12;

DESCRIPTION OF PREFERRED EMBODIMENTS AND BEST MODE OF THE INVENTION

Figure 1:
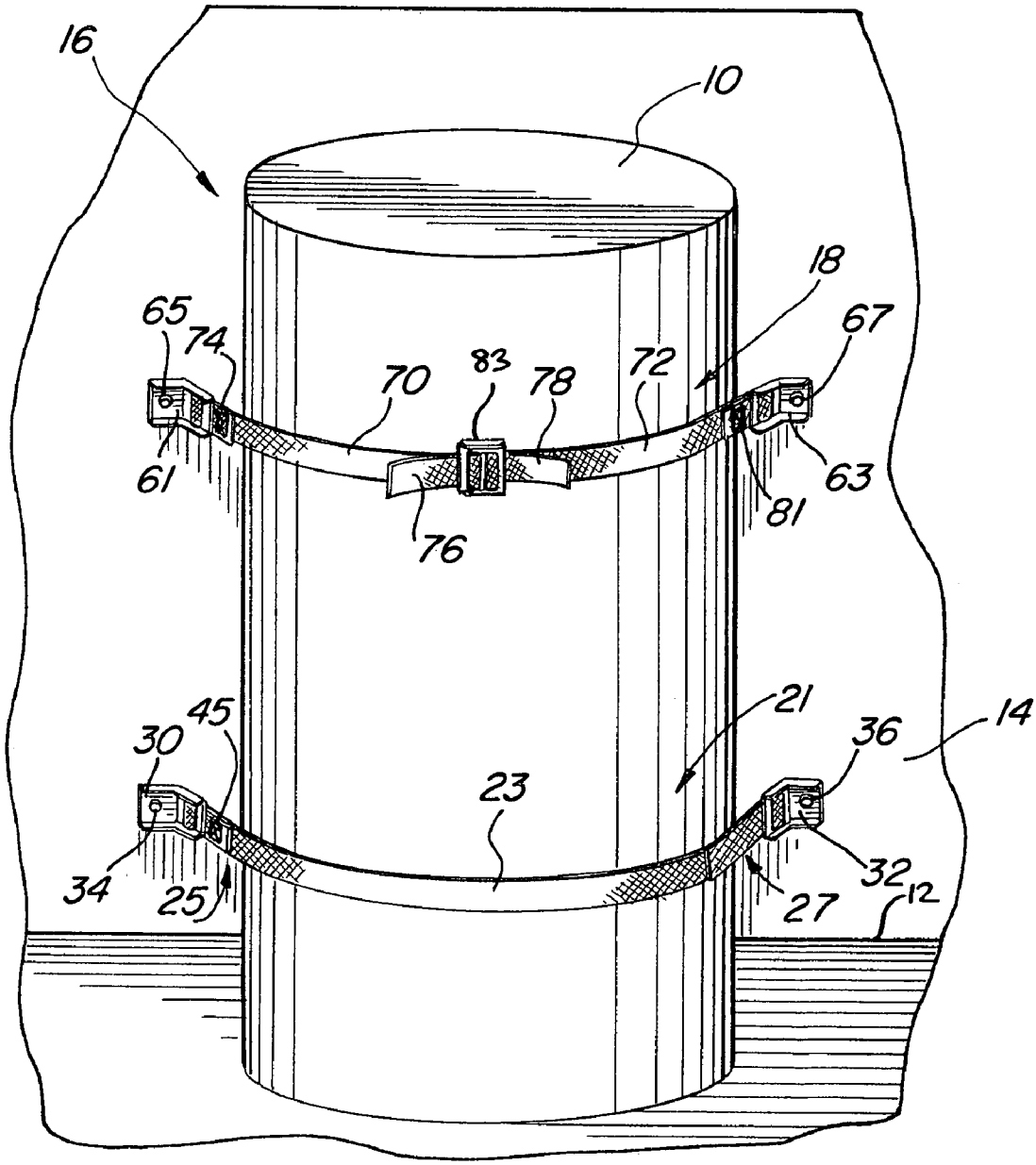
FIG. 1 is a front perspective view of a water heater held in close proximity to an adjacent wall by a security strap system of the present invention.

A water heater is illustrated in FIG. 1 and designated by the reference numeral 10. A floor 12 supports the water heater in proximity to an adjacent wall 14. A security system of the present invention surrounds a portion of the water heater 10 in order to maintain the water heater in a fixed relationship with the wall 14.

The security system 16 will typically include at least two strap assemblies 18 and 21 each of which extends partially around the circumference of the heater 10 and holds the heater 10 in a fixed relationship with the adjacent wall 14.

Of particular interest in each of the two strap assemblies 18 and 21 is a flexible strap such as that designated by the reference numeral 23 in the assembly 21. The flexibility of this strap is of particular interest as it greatly facilitates installation of the strap assemblies 18 and 21. The strap 23 will typically be woven of a material having a high tensile strength, such as nylon. Other materials of interest might include polyester, propylene, or a fiber such as KEVLAR (a trademark of DuPont De Nemours). The woven strap 23 will typically have very dull edges that are not at all threatening to an installer. Notwithstanding these significant advantages, the straps 23 can be provided with a tensile strength approaching that of some metals so they can withstand the significant vibrations commonly associated with earthquakes.

The strap assembly 21 is illustrated in its simplest form to include the single strap 23 having ends 25 and 27. The first end 25 is attached to a wall bracket 30 while the second end 27 is attached to a wall bracket 32. The wall brackets 30 and 32 are in turn attached to studs in the wall 14, typically with respective bolts 34 and 36. In the illustrated embodiment, there are two points of attachment between the strap 23 and the wall brackets 30 and 32. One of the attachments is formed at the end 25 with the bracket 30 while the other attachment is formed between the end 27 and the bracket 32. At least one of these attachments must be adjustable in order to permit the strap 23 to be cinched tightly around the water heater 10. The other of the attachments can be either permanent or adjustable.

Figure 2:
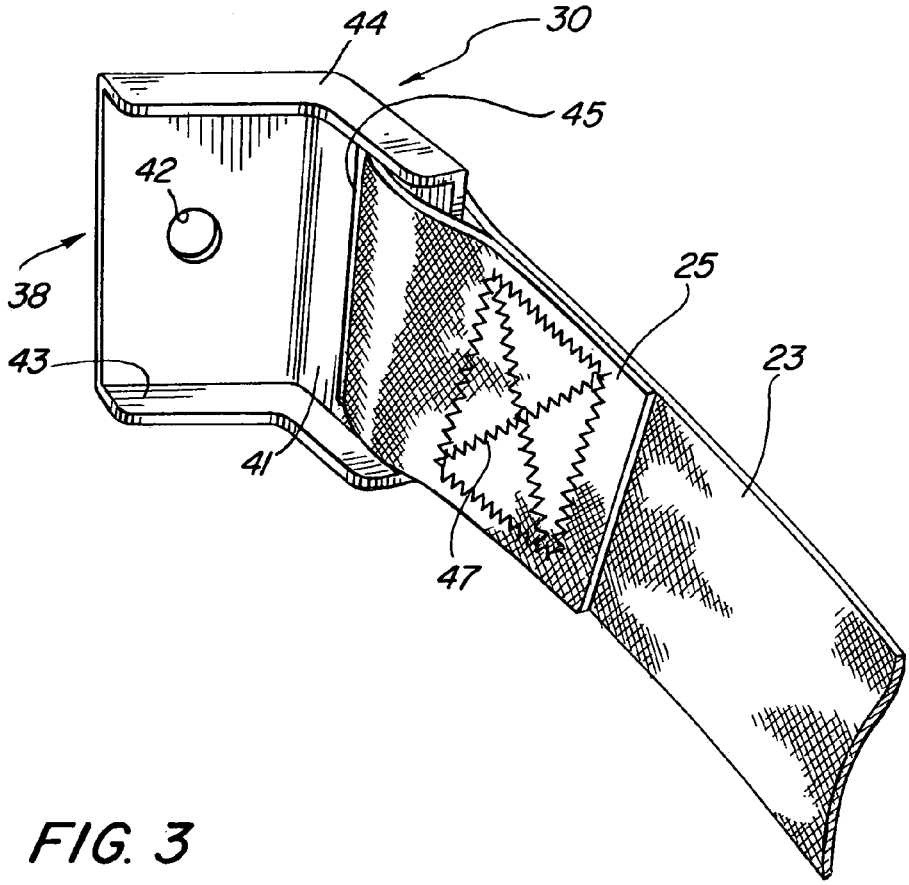
FIG. 2 is a perspective view of one embodiment of a wall bracket providing for a permanent fixed relationship with a strap end.

A permanent attachment between the end 25 and the strap 23 and the associated buckle 30 is illustrated in greater detail in FIG. 2. From this view it can be seen that, in a preferred embodiment, the wall bracket 30 can be formed with a wall portion 38 and an angled portion 41. The wall portion 38 can be provided with a hole 42 to receive the bolt 34 (FIG. 1). This wall portion 38 has a planar configuration and is intended to be held in a surface-contacting relationship with the wall 14. The angled portion 41 also has a planar configuration and in a preferred embodiment is disposed at an angle of about 135° to the wall portion 38. Side flanges 43 and 44 can be provided along the edges of the wall portion 38 and the angled portion 41 to add structural support to the wall bracket 30.

In this particular embodiment, which is adapted to accommodate a permanent attachment with the strap end 25, a single slot 45 is formed in the angled portion 41 preferably in a generally parallel relationship with the plane of the wall portion 38. The end 25 of the single strap 23 can be fed through this slot 45 and bent back on itself. The strap end 25 can then be sewn to the strap 23 in a multiplicity of stitches 47 to provide for permanent attachment of the strap 23 to the bracket 30.

If the attachment at the strap end 25 is made permanent, then the attachment at the strap end 27 must be adjustable in order that the strap might be cinched tightly against the water heater 10.

Figure 5:
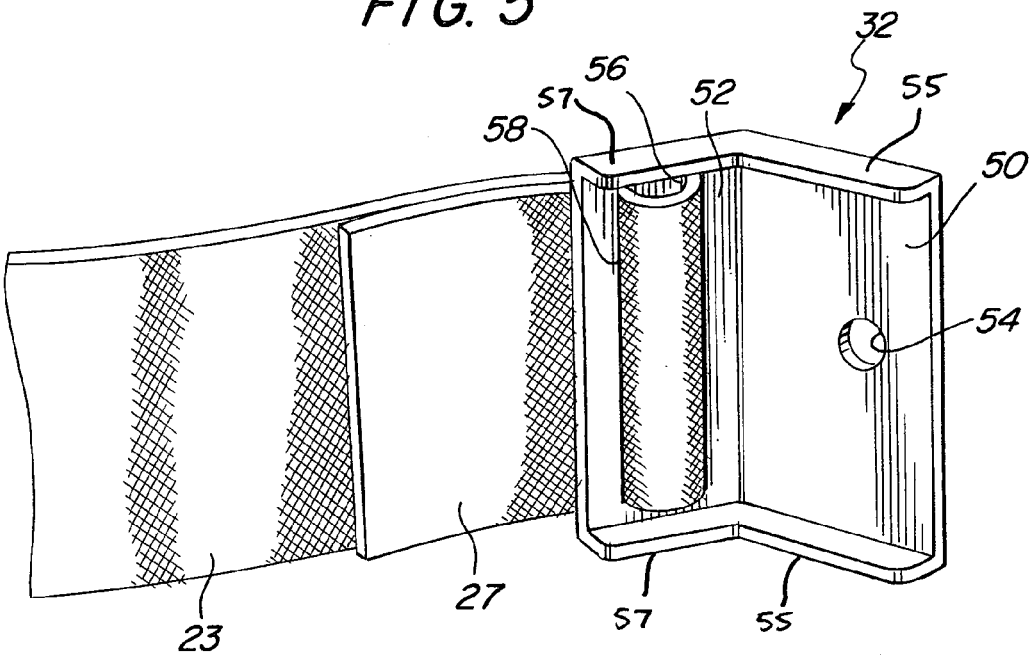
FIG. 5 is a perspective view of another embodiment of a wall bracket providing for an adjustable fixed relationship with a strap end.

A strap having an adjustable relationship with its bracket is illustrated in FIG. 5. In this embodiment, the bracket 32 is similar to the bracket 30 in that it includes a wall portion 50 and an angle portion 52. As in the previous case, the wall portion 50 is provided with a hole 54 to receive the bolt 36 (FIG. 1). Side flanges 55 and 57 are also provided in this embodiment. This wall bracket 32 differs from the wall bracket 30 in that two slots 56 and 58 are provided in the angled portion 52. These slots 56 and 58, in the illustrated embodiment, are parallel to each other and are also parallel to the wall portion 50.

During installation of the security system 16, the end 27 of the strap 23 can be threaded back to front through the slot 56 (as illustrated in FIG. 5) and then front to back through the slot 58. The strap end 27 can then be pulled to cinch the strap 23 snugly against the water heater 10. As the strap 23 is drawn tightly against the water heater 10, it also presses the strap end 27 against the angled portion 52 of the buckle 32. This pressure fixes the strap end 27 to the bracket 32 to maintain the tension on the strap 23.

Figure 3:
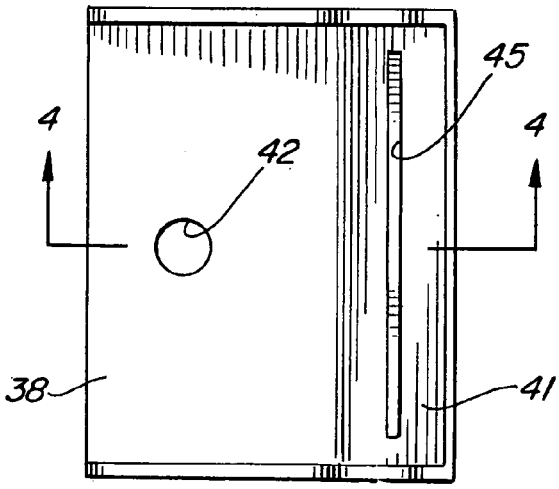
FIG. 3 is a top plan view of the wall bracket illustrated in FIG. 2.
Figure 4:
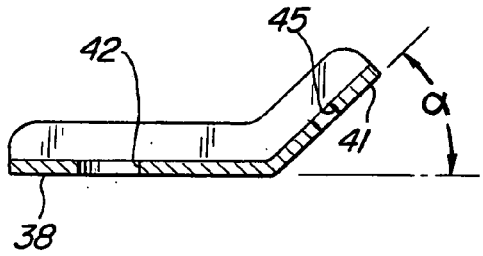
FIG. 4 is a cross section view taken along lines 4—4 of FIG. 3.

FIG. 3 shows the bracket 30 in a top plan view while a cross section view taken along lines 4—4 of FIG. 3 best illustrates placement of hole 42 in the wall portion 38 and placement of the slot 45 in the angled portion 41. In FIG. 4 it can also be seen that the angled portion 45 can be formed at an angle $\alpha$ to the wall portion 38. In a preferred embodiment, the angle $\alpha$ is about 45°.

Figure 6:
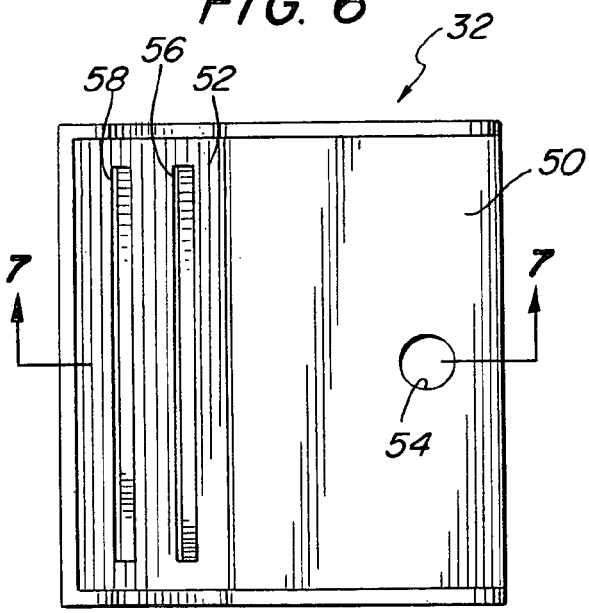
FIG. 6 is a top plan view of the wall bracket illustrated in FIG. 5.
Figure 7:
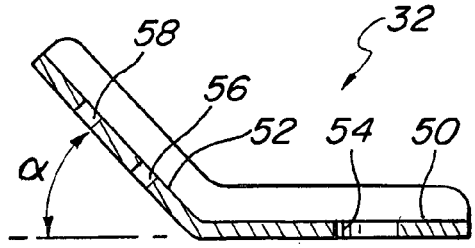
FIG. 7 is a cross section view taken along lines 7—7 of FIG. 6.
Figure 10:
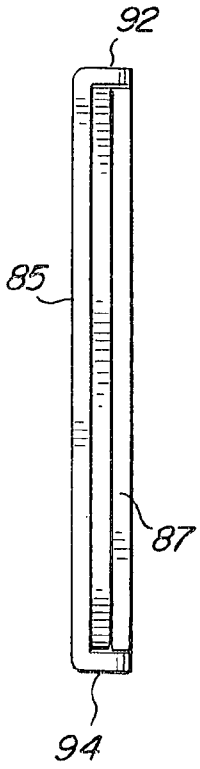
FIG. 10 is a left side elevation view of the buckle of FIG. 8.

FIG. 6 shows a top plan view of the bracket 32 and particularly the preferred placement of the hole 54 and slots 56 and 58. A cross section view taken along line 7—7 is illustrated in FIG. 7. In this view, the angle of the angled portion 52 relative to the wall portion 50 is preferably the same as the angle $\alpha$ in the bracket 30.

Returning to FIG. 1, it will be noted that the strap assembly 18 in the security system 16 differs from that previously discussed. In use, the strap assembly 18 will typically be the same as the strap assembly 21, so the differences illustrated in FIG. 1 are merely to facilitate a discussion of a different embodiment of the invention. Notwithstanding these differences, there are some similarities between the strap assemblies 18 and 21. For example, the strap assembly 18 includes two wall brackets 61 and 63. Bolts 65 and 67 can be used to attach these brackets 61 and 63 respectively to the adjacent wall 14.

The strap assembly 18, is formed with two straps 70 and 72. The strap 70 has a first end 74 and a second end 76, while the strap 72 has a first end 78 and a second end 81. In FIG. 1, the strap end 74 is attached to the bracket 61. This could be either a permanent attachment of the type illustrated in FIG. 2, or it could be an adjustable attachment as illustrated in FIG. 5. The strap end 81 can be similarly attached to the bracket 63 with alternatives for permanent or adjustable attachment.

The strap assembly 18 differs from the strap assembly 21 primarily in the provision of a buckle 83 that is adapted to receive the strap ends 76 and 78. The buckle 83 can be provided in many embodiments only two of which are illustrated in FIGS. 8 and 12.

Figure 8:
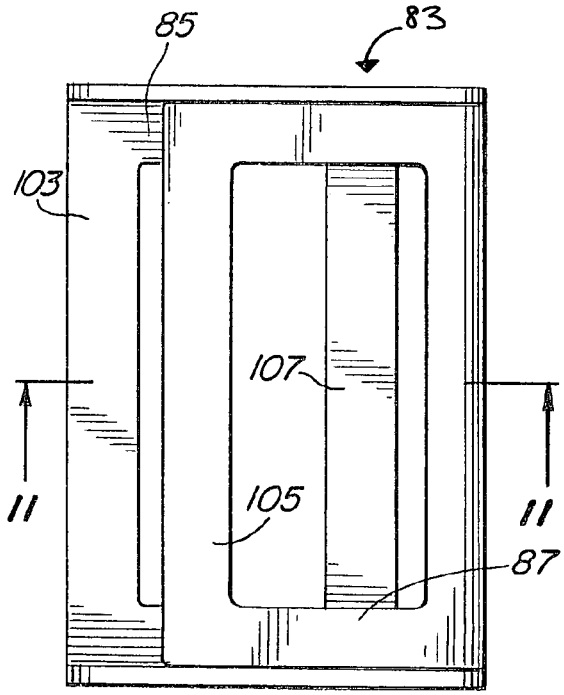
FIG. 8 is a top plan view of a buckle associated with another embodiment of the present invention.
Figure 9:
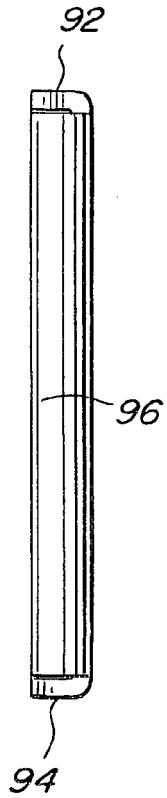
FIG. 9 is a right side elevation view of the buckle of FIG. 8.

The embodiment of FIG. 8 is of particular interest, as it can be stamped from sheet metal in a planar configuration and then bent back on itself to form an inner portion 85 of the buckle and an outer portion 87 of the buckle. The two portions 85 and 87 are separated to form a slide channel 90 best illustrated in the cross sectional view of FIG. 11. This channel 90 is further defined by side flanges 92 and 94, which in this embodiment extend outwardly from the inner portion 85 of the buckle 83. In a similar embodiment, the side flanges 92 and 94 might extend inwardly from the outer portion 87 of the buckle 83.

Figure 11:
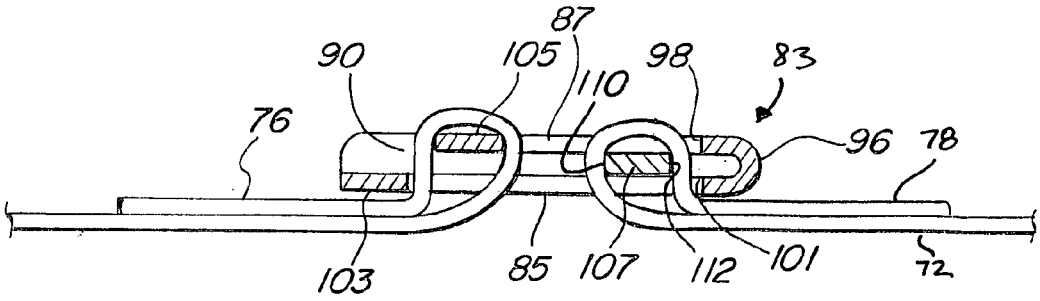
FIG. 11 is a cross section view taken along lines 11—11 of FIG. 8.

Along one edge of the buckle 83, where the outer portion 87 is bent back on the inner portion 85, a sidebar 96 is formed with a U-shaped cross section best illustrated in FIG. 11. This U-shaped sidebar 96 has two edges 98 and 101 that face toward the channel 90. On the side of the buckle 83 opposite the U-shaped sidebar 96, a sidebar 103 is fixed to the inner portion 85, and a crossbar 105 is fixed to the outer portion 87. To complete this buckle construction, a slide 107 is provided for movement along the channel 90 and into close proximity with the U-shaped sidebar 96. This slide 107 functions as a second crossbar and provides two edges 110 and 112 of particular interest to this embodiment of the invention.

Initially, it should be noted that if a permanent attachment is provided at both ends 74 and 76 of the strap 70, then the position of the buckle 83 is fixed relative to the water heater 10. If at least one of the ends of the strap 70 is made adjustable, then the position of the buckle relative to water heater 10 can be adjusted to place it in the most desirable location for cinching the strap 72.

For clarity, the attachment of the strap ends 76 and 78 to the buckle 83 is illustrated only in the cross sectional view of FIG. 11. Although only one of the strap ends 76 and 78 need be adjustably attached to the buckle 83, this adjustable attachment is provided for each of the strap ends 76 and 78 in the illustrated embodiment.

Initially, the strap end 76 is threaded beneath both of the sidebar 103 and the crossbar 105. Then the strap end 76 is moved outwardly and back across the crossbar 105. It is then fitted between the sidebar 103 and crossbar 105, and eventually threaded back on itself between the sidebar 103 and the strap 70. As noted, this can be a permanent attachment in which case the strap end 76 need only be bent around one of the crossbars 103 and 105 and sewn to the strap 70 with a multiplicity of stitches as illustrated in FIG. 2. In the embodiment illustrated, the attachment of the strap end 76 to the buckle 83 is an adjustable attachment.

In like manner, the end 78 of the strap 72 can be threaded through the buckle preferably in an adjustable configuration. The strap end 78 can initially be run beneath the U-shaped sidebar 96 as well as the slide 107. The strap end 78 can then be bent back on itself over the slide 107 and between the slide 107 and the U-shaped sidebar 96. At this point, the strap end 78 can be passed beneath the sidebar 96 and the strap 72.

Of all the strap ends that might alternatively be provided with a permanent attachment or an adjustable attachment, this strap end 78 would benefit the system 18 most with an adjustable construction to facilitate taking up the slack in the strap assembly. By merely pulling on the strap end 78, the slide will be drawn along the slot 90 into close proximity with the U-shaped sidebar 96. At this point, the strap end 87 is held in place by the edges 98 and 101 of the sidebar 96, as well as the edges 110 and 112 of the slide 107. By tensioning the strap end 78, the gripping force of the buckle on the strap 72 is greatly increased by the pressure of these edges 98, 101, 110, and 112 on the strap end 87.

A further embodiment of the buckle 83 is illustrated in FIG. 12 where elements of structure similar to those previously discussed are designated with the same reference numeral followed by the lower case letter "a." Thus, the buckle 83*a* includes the inner portion 85*a*, the outer portion 87*a*, the sidebar 103*a* the crossbar 105*a* and the U-shaped sidebar 96*a*. In the absence of the side flanges 92 and 94, the channel 90*a* is defined solely by these elements.

In this embodiment, the slide 107*a* is movable along the channel 90*a*, but is provided with side flanges 114 and 116, which hold the slide 107*a* in place. With this difference, the buckle 83*a* can be threaded in the manner previously discussed with reference to FIG. 11. It will also be apparent in this embodiment that tensioning of the strap end 78 will only increase the bite on the strap that is provided by the edges 98*a* and 101*a* of the sidebar 96*a*, as well as the edges 110*a* and 112*a* of the slide 107*a*.

Having discussed some of the preferred embodiments, it will be apparent that many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in the foregoing specification to describe the invention and its various embodiments are to be understood not only in the sense of their commonly defined meanings, but also by special definition, other structures, materials or acts beyond the scope of their commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Thus, the detailed description set forth above in connection with the appended drawings is intended as a description of the presently preferred embodiment(s) of the invention and is not intended to represent the only form(s) in which the present invention may be constructed or utilized. The description sets forth the functions and the sequence of steps for constructing and operating the invention in connection with the illustrated embodiment(s). It is to be understood, however, that the same or equivalent functions may be accomplished by different embodiments that are also intended to be encompassed within the spirit of the invention as set forth in the following claims.

Figure 16:
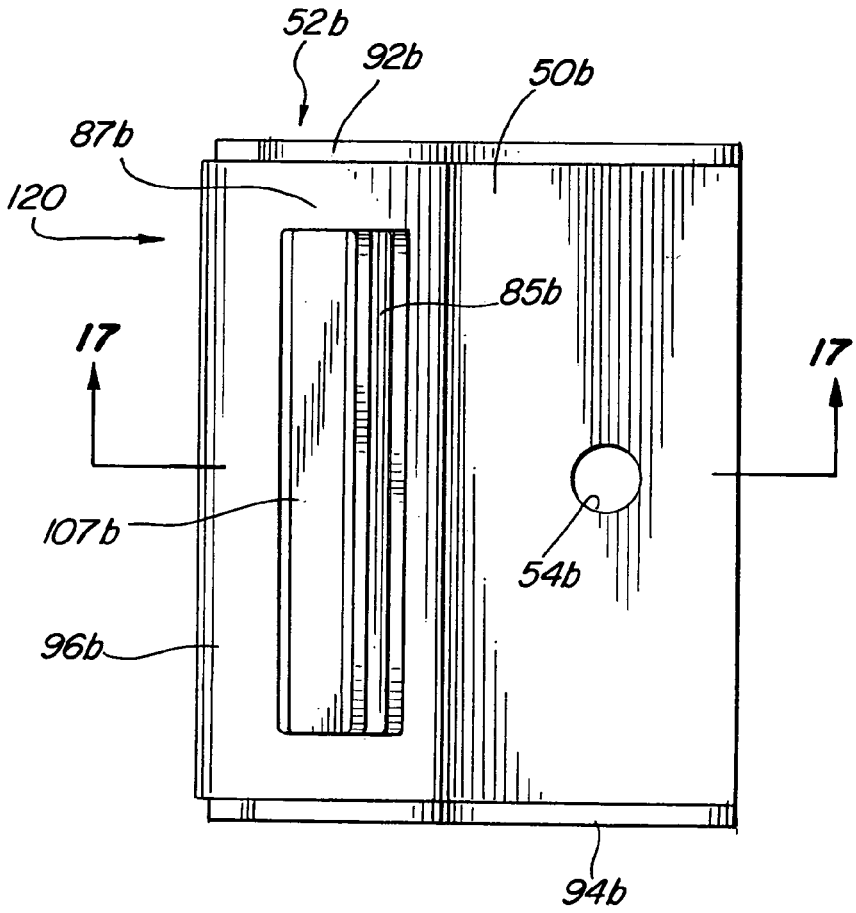
FIG. 16 is a top plan view of an additional embodiment of a wall bracket associated with the present invention.
Figure 17:
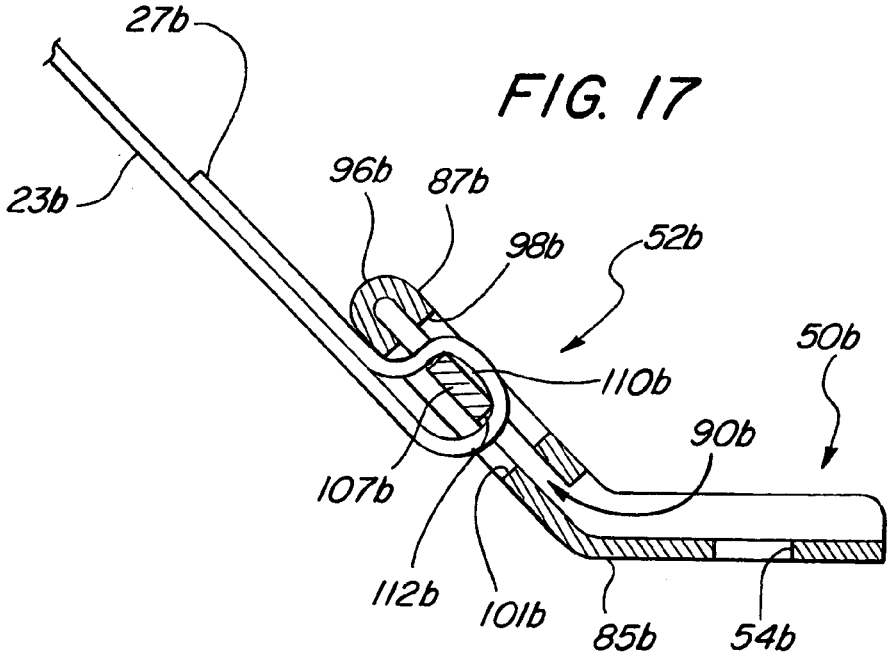
FIG. 17 is a cross section view taken along lines 17—17 of FIG. 16.

A further embodiment of a wall bracket is illustrated in FIG. 16 where elements of structure similar to those previously discussed are designated with the same reference numeral followed the lower case letter "b." In this embodiment, a wall bracket 120 includes the wall portion 50*b* as well as the angled portion 52*b*. A hole 54*b* is formed in the wall portion 50*b* and adapted to receive a bolt (not shown). The angled portion 52*b* can be bent at the angle $\alpha$ with respect to the wall portion 50*b*. This angled portion 52*b* is otherwise very similar to the buckle embodiment illustrated in FIG. 8. More specifically, the angled portion 52*b* includes an inner portion 85*b* and an outer portion 87*b* that define a channel 90*b* therebetween. Side flanges 92*b* and 94*b* are provided in this embodiment. The U-shaped sidebar 96*b* is formed between the inner portions 85*b* and outer portions 87*b*, and the slide 107*b* is movable within the channel 90*b*.

The strap 23*b* with its end 27*b* is threaded around the slide 107*b* and can be cinched tight to engage the edges 98*b*, 101*b*, 110*b* and 112*b* in a fixed or locking relationship. In still a further embodiment, the side flanges 114 and 116 discussed with reference to FIG. 13 could be added to the slide 107*b* in place of the side flanges 92*b* and 94*b*.

The invention claimed is:

1. A buckle adapted to receive a first strap in an adjustably fixed relationship and a second strap, comprising: an inner portion disposed generally in a first plane;

an outer portion bent back on the inner portion and disposed generally in a second plane parallel to the first plane;

the outer portion forming a first sidebar with the inner portion, the first sidebar being generally parallel to the first plane of the inner portion and the second plane of the outer portion and having a first pair of strap engagement edges;

the inner portion and the outer portion defining with the first sidebar a channel;

a slide movable within the channel generally parallel to the first sidebar, the slide having a second pair of strap engagement edges whereby the first strap can be threaded around the slide and cinched tightly to engage the first strap with the first and second pair of strap engagement edges and thereby form the fixed relationship with the buckle; and a bar adapted to engage the second strap.

2. The buckle recited in claim 1 wherein:

the inner portion of the buckle is adapted for attachment to a wall.

3. The buckle recited in claim 1 further comprising:

side flanges formed alternatively on the inner portion of the buckle and the slide of the buckle.

4. The buckle recited in claim 1, wherein the bar comprises a crossbar.

5. The buckle recited in claim 1, wherein the bar comprises a second side bar.

* * * * *